US005635323A

United States Patent [19]

Nakamura et al.

[11] Patent Number: 5,635,323

[45] Date of Patent: Jun. 3, 1997

[54] IMAGE FORMING METHOD

[75] Inventors: Yasushige Nakamura; Norio Sawatari; Tsuneo Watanuki; Fumio Takei; Toru Takahashi; Yasuyuki Furuse, all of Kawasaki, Japan

[73] Assignee: Fujitsu Limited, Kanagawa, Japan

[21] Appl. No.: 460,145

[22] Filed: Jun. 2, 1995

[30] Foreign Application Priority Data

| | | | |
|---|---|---|---|
| Jun. 3, 1994 | [JP] | Japan | 6-144050 |
| Mar. 20, 1995 | [JP] | Japan | 7-085920 |

[51] Int. Cl.[6] ..... G03G 13/22

[52] U.S. Cl. ..... 430/55; 430/120

[58] Field of Search ..... 430/109, 106.6, 430/111, 55, 120

[56] References Cited

U.S. PATENT DOCUMENTS

| | | | |
|---|---|---|---|
| 4,618,241 | 10/1986 | Hays et al. | 430/120 |
| 5,456,990 | 10/1995 | Takagi et al. | 430/111 |

FOREIGN PATENT DOCUMENTS

| | | |
|---|---|---|
| 0434253A1 | 6/1991 | European Pat. Off. . |
| 54-84730 | 7/1979 | Japan . |
| 59-58438 | 4/1984 | Japan . |
| 60-87352 | 5/1985 | Japan . |
| 63-186253 | 8/1988 | Japan . |
| 2-176763 | 7/1990 | Japan . |
| 3-155565 | 7/1991 | Japan . |
| 4-156555 | 5/1992 | Japan . |
| 4-225368 | 8/1992 | Japan . |
| 5-15055 | 1/1993 | Japan . |
| 5-53374 | 3/1993 | Japan . |
| 5-142857 | 6/1993 | Japan . |
| 5-150667 | 6/1993 | Japan . |
| 6-186821 | 7/1994 | Japan . |
| WO91/00548 | 1/1991 | WIPO . |

OTHER PUBLICATIONS

"Magnet Blow–Off Method for Toner Charge Measurement", Nakajima et al, *Fujitsu Scientific & Technical Journal*, vol. 17, No. 4, Dec. 1981, pp. 115–127.

*Primary Examiner*—John Goodrow

*Attorney, Agent, or Firm*—Nikaido, Marmelstein, Murray & Oram LLP

[57] ABSTRACT

A toner used meets the requirement that the value determined by the equation $6/(d_t \cdot \rho_t \cdot S)$, wherein $d_t$ is the volume average particle diameter of the toner, $\rho_t$ is the density of the toner, and Fs is the specific surface area of the toner, is in the range of 0.75 to 0.90, and the amount of electrification as measured by a magnet blow-off method is in the range of 10 to 40 μC/g in terms of absolute value. A carrier used meets the requirement that the magnetic susceptibility is not less than 90 emu/g (at 1 kOe), the specific surface area is not less than 1000 $cm^2/g$ to 1800 $cm^2/g$, the electric resistivity is $10^6$ to $10^{12}$ Ωcm, and the average particle diameter is 20 to 100 μm.

7 Claims, 10 Drawing Sheets

(1) UNIFORM ELECTRIFICATION ON SURFACE OF PHOTORECEPTOR (2) EXPOSURE:GENERATION AND TRANSPORT OF ELECTRIC CHARGE (3) DEVELOPMENT BY BIAS ELECTRIC FIELD
HOLDING OF TONER AT PRINTED AREA
(ELECTRIC FORCE > MAGNETIC FORCE)
RECOVERY OF TONER AT BACKGROUND AREA
(MAGNETIC FORCE > ELECTRIC FORCE)

TONER 1

TONER 2

TONER 3

TONER 4

TONER 6

TONER 5

TONER 7

IMAGE FORMING METHOD

BACKGROUND OF THE INVENTION

1. Field of the Invention

The present invention relates to an image forming method wherein development is carried out substantially simultaneously with imagewise exposure from within a photoreceptor, thereby forming a toner image on the photoreceptor, which method is remarkably improved over the conventional Carlson process, is free from evolution of ozone harmful to the human body, and can stably provide a good image at low cost.

2. Description of the Related Art

In recent years, rapid growth of computers and communication technology has led to an ever-increasing demand for printers as output terminals, and electrophotographic printers have rapidly become widespread by virtue of their excellent recording speed, print quality and other properties.

In the conventional electrophotographic system (Carlson process), a photoreceptor is used as a recording medium, and recording is carried out through a series of complicated steps of electrification, exposure, development, transfer, fixation, de-electrification, and cleaning, which steps limit the possible reductions in size and cost, and prevent realization of maintenance-free operation. For this reason, the development of a simpler developing process has been desired in the art. In recent years, attempts to carry out developing using a transparent photoreceptor have been made, and there is a report that a reduction in size can be realized by eliminating the above conventional electrification mechanism and disposing an optical system within a photoreceptor. For example, Japanese Patent Application No. 5-143262 proposes a process wherein an organic photoreceptor is used and developing is carried out with a toner and a carrier.

The principle of this process will now be described.

FIGS. 1 and 2 are diagrams showing the principle of forming an image by the above process. A photoreceptor 1 comprises a transparent substrate 2, a transparent conductive layer 3, and a photoconductive layer 4, and the transparent conductive layer is grounded. A developer 5 comprises a high-resistance carrier 6 and an insulating toner 7. A developing roller 8 comprises a magnet roller 9 and, provided thereon, a conductive sleeve 10. The developer is attracted to the developing roller by magnetic force, deposited on the sleeve and, in this state, carried to the photoreceptor. Within a developing nip, the following three steps are successively carried out instantaneously. Specifically, in a zone (1), the photoreceptor 1 is subjected to electrification 12 through the developer 5. In a zone (2), the electrified photoreceptor 1 is then subjected to imagewise exposure through the transparent substrate 2 to form a latent image. Numeral 11 designates an optical system. Further, development occurs in a zone (3) at its latent image forming portion, because electrical adhesion 13 of the toner 7 to the photoreceptor 1 is higher than magnetic force 14 from the magnet roller 9, electrostatic attractive force from carriers on the magnet roller 9, and mechanical scraping force. Further, in the background other than the latent image forming portion, the toner 7 is recovered by taking advantage of the magnetic force and electrostatic attractive force from the magnet roller 9 and the magnetic carriers and the mechanical scraping force. Therefore, as compared with a nonmagnetic toner, a magnetic toner, by virtue of using magnetic attractive force, is more advantageous as a toner from the viewpoint of the prevention of background fog. Since, however, a nonmagnetic toner can be recovered by taking advantage of electrostatic attractive force from the carriers and the mechanical scraping force, it is also possible to use a nonmagnetic toner. The developed toner is transferred onto a recording medium, that is, paper or a plastic sheet, to provide a print. The above process will be hereinafter referred to as "optical back recording process or system."

The above-described optical back recording system is different from the conventional system (hereinafter referred to as "Carlson system"). As is well known in the art, for the Carlson system, the electrification of a photoreceptor, exposure, and development are carried out by separate processes, enabling the electrification potential of the photoreceptor to be set at a higher value than the developing bias so as not to cause background fog. The toner is carried electrostatically to the latent image, whereas no toner is deposited on the background. On the other hand, for the optical back recording system, since the surface potential of the photoreceptor is created by the developing bias, the potential of the photoreceptor is equal to or, due to a small decrease in efficiency, smaller than the developing bias. Therefore, the toner deposited on the background is recovered by the magnetic or electrostatic attractive force from the magnetic roller and the mechanical scraping force. An enhancement in the recovering capability for the purpose of reducing background fog results in lowered print density. The attainment of a combination of reduced background fog and a high print density is highly sought after in the art.

Further, for the optical back recording system, electrification and development occur substantially simultaneously in the photoreceptor through a developing agent. This necessitates the use of a developing agent having high electrification and development capability. However, when the developing agent disclosed in Japanese Unexamined Patent Publication (Kokai) No. 5-15055 is used, the toner concentration margin (which means that satisfactory printing properties can be obtained in a toner concentration of 10 to 30% by weight) is unsatisfactory. Satisfactory printing properties should be obtainable in a toner concentration of 10 to 30% by weight is that demand for reduced cost has led to a tendency for the conventional toner concentration control system using a magnetic sensor to be replaced by an automatic toner concentration control system as disclosed in Japanese Unexamined Patent Publication (Kokai) No. 5-150667. The conventional magnetic sensor can control the toner concentration to any desired value within ±2%, whereas the above automatic toner concentration control system can carry out only a rough control of the toner concentration, i.e., to the extent that the toner concentration will fall within a range of 10 to 30% by weight.

DESCRIPTION OF THE INVENTION

As a result of extensive and intensive studies, the present inventors have found that, in the optical back recording system, the influence of the shape of the toner, the amount of electrification of the toner, and the shape of the carrier on the print density and background fog is larger than in the case of the Carlson system, and that a high print density and low fog can be realized by regulating the shape of the toner, the amount of electrification of the toner, and the shape of the carrier.

The shape of the toner is expressed using a method described in Japanese Patent Application No. 5-177236, that is, in terms of the ratio of a specific surface area determined by calculation, assuming that the toner is in a homogeneous, truly spherical form to a specific surface area (S) measured by the BET method (this ratio being hereinafter referred to as "Fs value"), specifically $$Fs=6/(\rho_t \cdot d_t \cdot S)$$

As the Fs value increases, the shape becomes close to a true sphere. The Fs value is theoretically between 0 and 1. Volume average particle diameter ($d_t$) as measured with a Coulter Counter (manufactured by Coulter Electronics K.K.), toner density ($\rho_t$), and specific surface area (S) measured by the BET method using a gas mixture of 70% helium and 30% nitrogen are used in the calculation of Fs.

In this case, it was found that a good print can be obtained when the Fs value is in the range of 0.75 to 0.9 with the amount of electrification being in the range of 10 to 40 μC/g in terms of absolute value. When the Fs value is less than 0.75, background fog is significant, while when it is more than 0.9, the print density is reduced. If the amount of electrification, in terms of absolute value, is less than 10 μC/g whether the electrification is positive or negative, failure of transfer occurs, while if it is more than 40 μC/g, background fog becomes significant, rendering the toner unsuitable for practical use. The Fs value was found to be still more preferably in the range of 30 to 20 μC/g.

The amount of electrification was measured by the magnet blow-off method (J. Nakajima and J. Tashiro: FUJITSU Scientific & Technical Journal, Vol. 17, No. 4, p. 115 (1981)). Specifically, an apparatus wherein a mesh of a machine for measuring the amount of electrification (manufactured by Toshiba Chemical Corp.) was replaced with a magnet is disclosed. On the other hand, for the mesh blow-off method, the electrification caused by friction between the developer and the mesh at the time of blowing off the developer is also counted. For this reason, the absolute value measured by the mesh blow-off method is usually about 10 μC/g higher than that measured by the magnet blow-off method.

Examples of the conventional toner include a toner having an Fs value in the range of 0.5 to 0.73 (Japanese Unexamined Patent Publication (Kokai) No. 5-142857) and a toner having an Fs value in the range of 0.66 to 1 (Japanese Unexamined Patent Publication (Kokai) No. 59-58438). The techniques disclosed in these documents do not relate to optical back recording, but to the conventional recording system. More specifically, neither document suggests that a toner having such a high Fs value is applicable to or useful in an image forming apparatus for optical back recording contemplated in the present invention. Further, optical back recording properties are not determined by the Fs value alone, and as with the Fs value, the amount of electrification is also an important factor. Both the documents are completely silent on this point.

The toner will now be described in more detail. An emulsion-polymerized toner is preferably used as the toner because the shape can be easily varied (the shape being freely variable to those ranging from a sphere to an indefinite shape). The emulsion-polymerized toner is prepared by subjecting a radical polymerizable monomer to emulsion polymerization (or non-emulsion polymerization) and associating the resultant resin particles with carbon and a charge control agent in water to provide a toner. After the association, the resultant toner is heated in water to bring the resin particles to a melted state to vary the shape of the particles. In this case, the shape can be freely varied to those ranging from an indefinite shape to a sphere (Japanese Unexamined Patent Publication (Kokai) No. 63-186253). According to experiments conducted by the present inventors, the Fs value could be controlled in the range of 0.2 to 0.95.

Although the emulsion-polymerized toner is considered most effective for control of its shape, a suspension-polymerized toner is also considered usable (Japanese Unexamined Patent Publication (Kokai) Nos. 54-84730 and 3-155565 and the like). The toner prepared by this conventional method has a truly spherical form having an Fs value of not less than 0.95 which often causes decreased print density in optical back recording. Preferably, a suspension-polymerized toner having an Fs value in the range of 0.75 to 0.9 may be used which, during production of the toner, has been subjected to some dimple treatment or treatment for rendering the shape of the toner indefinite by taking advantage of pressurization treatment (Japanese Unexamined Patent Publication (Kokai) No. 4-156555), agitation conditions, heating conditions, and the like.

Besides the Fs value, Wardar's practical sphericity is known as a measure of the shape of the toner (Japanese Unexamined Patent Publication (Kokai) No. 4-225368: Fujitsu). Wardar's sphericity and the Fs value are calculated by the following respective equations:

Practical sphericity=(the diameter of a circle having an area equal to the projected area of the particle)/(the diameter of a circle circumscribing the plane of projection of the particle $$Fs=6/(d_t \cdot \rho_t \cdot S)$$

According to the above equations, Wardar's sphericity is related to the projected area of the particle and, hence, reflects the shape of a particle as viewed macroscopically, and as the Fs value approaches 1, the shape becomes close to a sphere. For optical back recording, however, background fog worsens by increasing the force by which the toner is adhered to the photoreceptor. This suggests that background fog worsens with increasing attractive force at very short range (submicrons or less), such as van der Waals force and image force. In this case, if the shape of the toner is expressed in terms of Wardar's sphericity, the difference in shape over submicron regions on the surface of the particle is not reflected at all. In contrast, for the Fs value, since the surface area as measured by a gas adsorption method, such as the BET method, is used, subtle differences in shape over submicron regions are sufficiently reflected, enabling the force (van der Waals force and image force), by which the toner is deposited on the photoreceptor, to be satisfactorily expressed.

As an example, a toner produced by the pulverization process will now be compared with one produced by the polymerization process. Although the toner produced by emulsion polymerization is oval, the surface is smooth. Therefore, as compared with the toner produced by the pulverization process, the Fs value is larger although Wardar's value is smaller. The background fog decreases with increasing Fs values independently of Wardar's value.

| | Wardar's value | Fs value | Background fog |
|---|---|---|---|
| Toner by pulverization process | 0.71 | 0.33 | Large |
| Toner by polymerization process | 0.41 | 0.43 | Small |

In the toner, the amount of electrification can be controlled as desired by varying the kind and amount of a charge control agent (for example, an azo-chrome compound) added. In the toner produced by polymerization, the radical polymerizable monomer usable in the present invention may be a monomer having in one molecule one ethylenically unsaturated bond. Examples thereof include styrene and derivatives thereof; α-methylene fatty acid monocarboxylic acid esters, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic esters, such as methyl acrylate, ethyl acrylate, n-butyl acrylate, and isobutyl acrylate; vinyl ethers, such as vinyl methyl ether, vinyl ethyl ether, and vinyl isobutyl ether; vinylketones, such as vinyl methyl ketone, vinyl hexyl ketone, and methyl isopropenyl ketone; N-vinyl compounds, such as N-vinylpyrrole, N-vinylcarbazole, N-vinylindole, and N-vinylpyrrolidone; vinylnaphthalenes; and acrylic acid or methacryclic acid derivatives, such as acrylonitrile, methacrylonitrile, and acrylamide. They may be used alone or in the form of a mixture of two or more.

In the suspension-polymerized toner, compounds soluble in the monomer (such as azobisisobutyronitrile, benzoyl peroxide, methyl ethyl ketone peroxide, and isopropyl peroxycarbonate) are usually used as a polymerization initiator. It is also possible to use these compounds in combination with hydrogen peroxide soluble in water or the like. On the other hand, in the emulsion-polymerized toner, it is also possible to successfully conduct polymerization even if use is made of a polymerization initiator usually soluble in water, for example, persulfates, such as potassium persulfate, and aqueous hydrogen peroxide, or a redox polymerization initiator.

Charge control agents include azo-chrome (negative electrification), nigrosine (positive electrification), ammonium (positive and negative electrification), and other known charge control agents.

In the above toners, silica, titanium oxide, alumina, resin powder, and known other external additives may be used.

The photoreceptor may comprise an organic material, such as a phthalocyanine or azo compound. The substrate of the photoreceptor may comprise a transparent or translucent material, such as glass or acrylic resin. The transparent or translucent conductive layer of the photoreceptor may be formed by vapor deposition of an inorganic material, such as ITO or $SnO_2$; dispersion of ITO, $SnO_2$, or the like in a resin followed by coating; or coating of a solvent-soluble organic material, such as polyaniline. Among these methods, the coating method is preferred from the viewpoint of cost.

Carriers usable in combination with the above toner include conventional materials, such as iron powder, magnetite, and ferrite. In this case, the carriers may be coated with a general-purpose material, such as an acrylic, styrene-acrylic, or silicone resin. Further, it is also possible to use a resin carrier prepared by incorporating a magnetite powder into a resin. Among the above carriers, an iron powder, which has the highest magnetic force, is preferred from the viewpoint of deposition of the carrier. Further, regarding the particle diameter, the average particle diameter is preferably in the range of 10 to 50 μm, still preferably in the range of 20 to 45 μm. When it is smaller than 10 μm, fine particles occupy a large proportion, resulting in increased amount the carrier deposited on the photoreceptor. This reduces the amount of useful carriers, deteriorating the print quality. On the other hand, when the average particle diameter exceeds 50 μm, in the case of optical back recording, the electrification potential of the photoreceptor becomes uneven, making it impossible to provide a print having a high resolution.

For the electric resistance of the carrier, good results on a reduction in background fog can be attained in both conductive low-resistance carriers and insulating medium- and high-resistance carriers. However, when the electric resistivity is less than $10^2$ Ωcm, leakage at the developing area gives rise to breakage of the photoreceptor and excessively increased degree of development, making it difficult to provide a good print having a good resolution. For this reason, the electric resistivity of the carrier is preferably not less than $10^2$ Ωcm, still preferably not less than $10^3$ Ωcm. In this case, the electric resistivity of the carrier is measured by placing 1 $cm^3$ of carrier between 1 $cm^3$ parallel electrodes (electrode spacing: 1 cm) with a given magnetic field (magnetic flux density 950 Gauss, magnetic field strength 340 Oe) being applied thereto, applying a direct current voltage of 100 V to measure a current value i (A) at that time, and calculating the resistivity R by the following equation $R=100/i$.

Further, the present inventors have found that increasing the specific surface area of the carrier can increase the toner concentration and toner shape margin. More specifically, it has been found that good printing properties can be obtained even when the toner concentration is in the range of 10 to 30% by weight when the carrier (preferably an iron powder) meets the following requirements:

(1) magnetic susceptibility: not less than 90 emu/g (at 1 kOe), (2) specific surface area: 1000 $cm^2/g$ to 1800 $cm^2/g$, (3) electric resistivity: $10^2$ to $10^6$ Ωcm, and (4) average particle diameter: 20 to 45 μm.

Furthermore, even a toner produced by the pulverization process can realize a high print density and a low background fog.

A flaky iron powder is particularly preferred which has such a shape that, when the sides of a rectangular parallelopiped circumscribing the carrier are respectively assumed to be A, B, and C with A>B>C, A=B>C, or A>B=C, the average value of B/A is 0.30 to 1.00 and the value of C/A is 0.05 to 0.40.

When magnetic particles, having a magnetic susceptibility of not more than 90 emu/g, of magnetite, ferrite, and a dispersion of a magnetic powder in a resin are used, the magnetic particles are, upon electrification, unfavorably deposited on the photoreceptor. In the case of an iron powder having a specific surface area of not more than 1000 $cm^2/g$, background fog occurs when the toner concentration is not less than 10% by weight. On the other hand, an iron powder having a specific surface area of not less than 1800 $cm^2/g$ cannot be produced because the production thereof is attended with danger of ignition. The reason for this is believed to reside in that, since the toner holding capability per unit weight increases with increasing specific surface area, the electric resistance of the developing agent is less likely to change even in the case of a high toner concentration. An iron powder having an electric resistivity of not more than $10^2$ Ωcm has low electric resistivity also in the form of a developing agent, so that a leak is likely to damage the photoreceptor. When an iron powder having an electric resistivity of not less than $10^6$ Ωcm is used, the developing agent has an electric resistivity of not less than $10^{12}$ Ωcm, which makes it impossible to carry out electrification through introduction of electric charges into the photoreceptor, resulting in background fog. If the average particle diameter of the iron powder is less than 20 μm, the particles are unfavorably deposited on the photoreceptor at the time of electrification through the iron powder. On the other hand, when the average particle diameter of the iron powder is more than 45 μm, the distance of iron powder particles from one another in the developing agent becomes large, which renders the electrification of the photoreceptor unsatisfactory, resulting in occurrence of background fog of the resultant print. An iron powder in the form of a true sphere produced by atomization, a porous sponge iron powder, and a flaky iron powder are generally known as the iron powder, and background fog occurring for an iron powder in the form of a true sphere, a porous iron powder, i.e., the so-called "sponge iron powder," and usual flaky iron powder.

The iron powder used herein may be coated with a resin. For example, coating of a resin, such as styrene/acrylic, polyester, epoxy, or silicone resin, with conductive carbon being dispersed therein enables the electric resistance to be controlled as desired. However, coating of an iron powder with a resin followed by implantation of carbon into the surface of the coating is unacceptable because continuous printing causes the carbon to come off, resulting in a change in electric resistivity.

The toner may be prepared by the conventional pulverization process or directly by suspension polymerization or emulsion polymerization. However, from the viewpoint of the shape of the toner, toner directly prepared by suspension polymerization or emulsion polymerization, as compared with toner having an indefinite shape, is more preferable because it has smaller adhesion to the photoreceptor and better electrification stability, flowability, and developing properties (Japanese Patent Application No. 06-144050).

However, it is most preferred to use a combination of the novel toner of the present invention (Fs: 0.75 to 0.90, amount of electrification of the toner: 10 to 40 μC/g in terms of absolute value) with the carrier of the present invention (satisfying the above requirements (1) to (4) or the above requirements (1) to (4) and, further, (5)).

The developing roll used may comprise a magnet within a conductive nonmagnetic sleeve. In this case, the magnet may be fixed with the sleeve only being rotatable. Alternatively, both the magnet and the sleeve may be rotatable. Further, a multipolar magnet roller of which the number of magnetic poles is not less than 20 may be directly rotated.

Since in the optical back recording system the formation of a latent image and the development proceed in a substantially simultaneous manner, a photoreceptor of which the movement is very high is advantageous as the photoreceptor used in the optical back recording system. The photoconductive layer may be formed of either an inorganic material or an organic material. Since, however, inorganic materials have lower dark resistivity than organic materials, the electrification is unsatisfactory unless the resistivity of the developing agent used is reduced. For this reason, the use of an organic material is more advantageous.

The photoreceptor usable herein is specifically as follows.

The substrate for the photoreceptor may be formed of any known material having high enough transparency to permit light necessary for exposure to pass therethrough, such as glass, a PET film or a plastic.

The conductive layer of the photoreceptor is formed on the transparent substrate. It may be formed of any known material having transparency and conductivity, such as ITO (indium tin oxide), zinc oxide, a soluble conductive polymer, or a conductive coating comprising a conductive fine powder of ITO, zinc oxide, or the like dispersed in a resin. The thickness of the conductive layer is preferably about 10 Å to 30 μm. The photoconductive layer formed on the conductive layer may be formed of either an organic material (a phthalocyanine or polysilane compound) or an inorganic material (selenium or amorphous silicon).

In this case, the electric resistance of the carrier and the magnetic particles is measured by the same method as described above. Specifically, the resistivity R is determined by placing 1 $cm^3$ of carrier and magnetic particles between 1 $cm^3$ parallel electrodes (electrode spacing: 1 cm) with a given magnetic field (magnetic flux density 950 Gauss, magnetic field strength 340 Oe) being applied thereto, applying a direct current voltage of 100 V to measure a current value i (A) at that time, and calculating the resistivity R by the equation R=100/i. Regarding the diameter of the magnetic particles, the diameter of a circle circumscribing each particle is measured using an SEM photograph, and the average value of the measured diameters is determined as the diameter of the magnetic particles. The specific surface area of the carrier is measured with a specific surface area measuring device (SS-100, manufactured by Shimadzu Seisakusho Ltd.) by the air permeation method.

EXAMPLES

Apparatus Embodiment (1)

Figure 1:
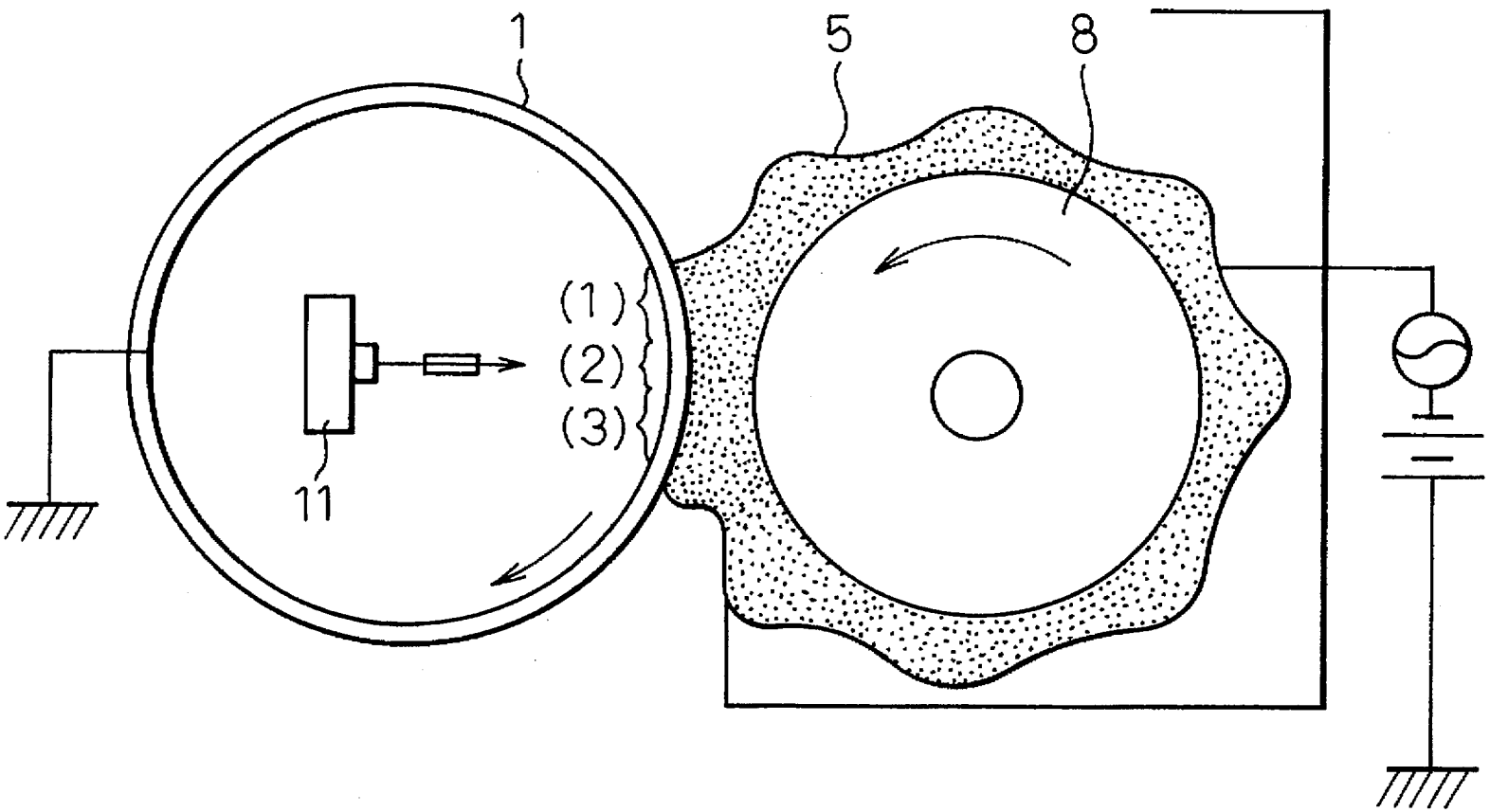
FIG. 1 is an explanatory view showing the principle of forming an image by an optical back recording process.
Figure 2A:
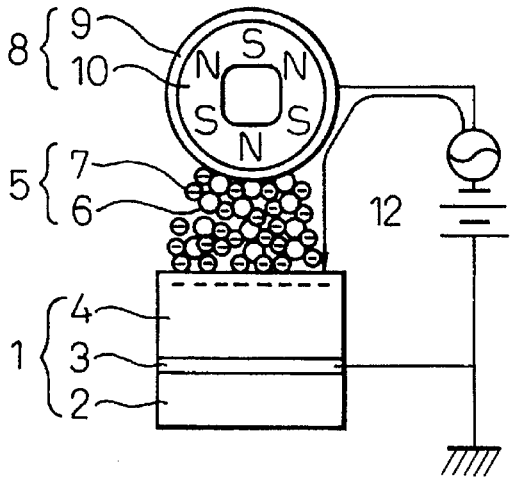
FIGS. 2A to 2C are explanatory views showing the principle of forming an image by an optical back recording process.
Figure 2B:
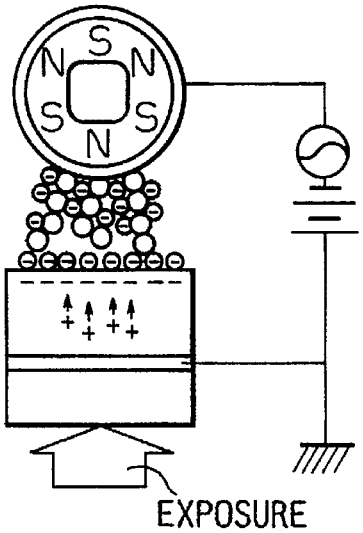
Figure 2C:
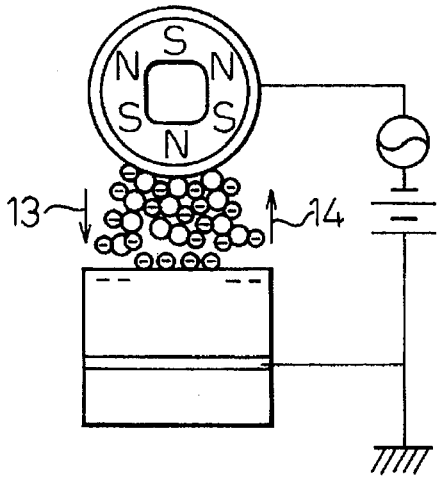
Figure 3A:
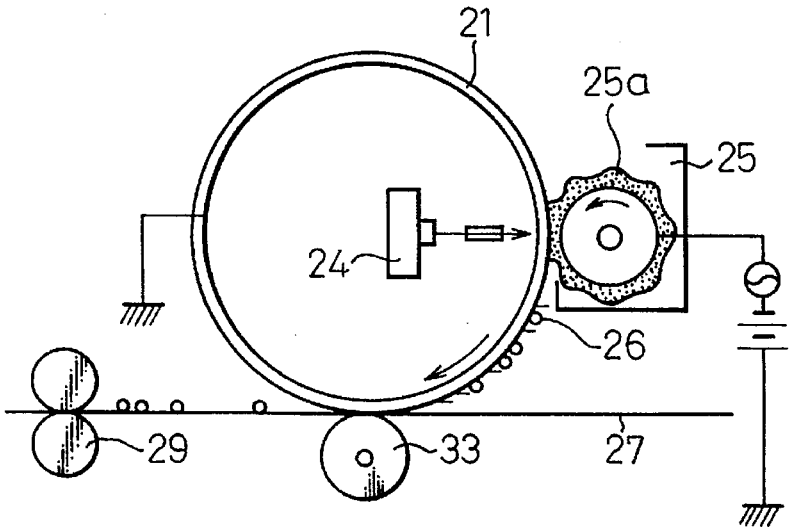
FIG. 3A is a view showing an optical back recording apparatus.
Figure 3B:
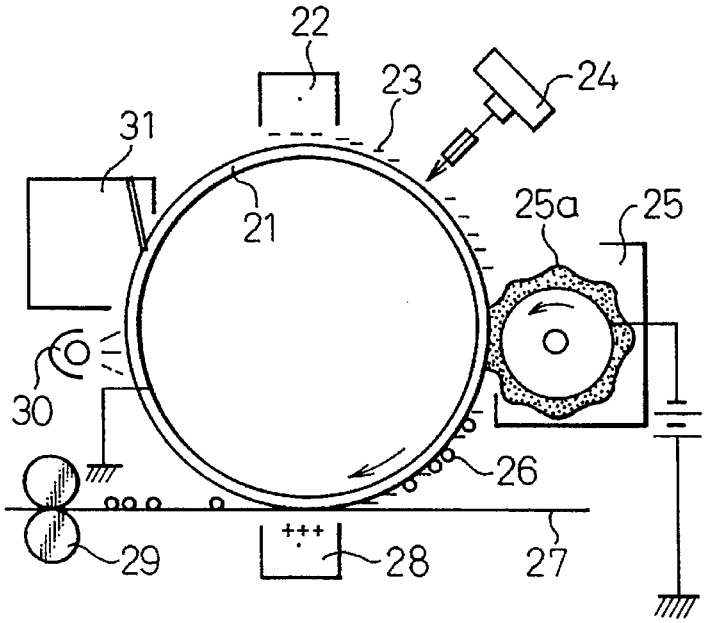
FIG. 3B is a view showing an apparatus for a Carlson process.

FIGS. 3A and 3B are diagrams for comparison of apparatuses. In FIGS. 3A and 3B, numeral 21 designates a photoreceptor drum (opaque), numeral 22 an electrifier, numeral 23 a surface potential, numeral 24 an optical system, numeral 25 a developing device, numeral 25*a* a developer, numeral 26 a toner, numeral 27 recording paper, numeral 28 a transfer device, numeral 29 a fixing device, numeral 30 a de-electrification lamp, numeral 31 a cleaner, numeral 32 a photoreceptor drum (a transparent support), and numeral 33 a transfer roller.

In the novel apparatus (FIG. 3A), unlike the conventional apparatus (FIG. 3B), the electrifier, de-electrification lamp, and cleaner can be omitted, and the optical system is disposed within the transparent photoreceptor. Further, also with respect to the transfer, the change from corona transfer to roller transfer can eliminate the evolution of ozone harmful to the human body, and the novel apparatus constitutes a system which can realize reductions in size, weight, and cost. The present apparatus will now be described in more detail. The present apparatus has a developing roller wherein a fixed magnet is provided within the roller and only a sleeve can be rotated. A carrier is present only on the developing roller which can feed only the toner. The photoreceptor used comprises a transparent glass tube, a conductive layer of polyaniline coated on the surface of the transparent glass tube, and an organic photosensitive layer (formed of a phthalocyanine compound) coated on the surface of the conductive layer.

An LED, which is contained in the photoreceptor, is used as the exposing means, facing a nip between the photoreceptor and the developing roller. Development is carried out by applying a voltage to a sleeve on the side of the developing roller under conditions of alternating voltage $V_{AC}$ of peak-to-peak voltage $V_{PP}$=1200 V and frequency 600 Hz and direct voltage $V_{DC}$=−500 V. In this case, the gap between the photoreceptor and the developing roller was 0.3 mm.

In this experiment, as described above, an alternating voltage with a DC voltage being superimposed on the AC voltage may be applied to the sleeve. Alternately, it is also possible to conduct constant-voltage regulation and constant-current regulation.

Further, it is also possible to carry out the development by the so-called "two-component developing process" wherein a carrier and a toner are present in the whole developing machine, or a developing process, as described in Japanese Unexamined Patent Publication (Kokai) No. 5-150667 and the like, wherein the toner concentration of the developer is automatically regulated using a small amount of carrier.

The peripheral speed of the photoreceptor was 24 mm/sec.

Figure 4:
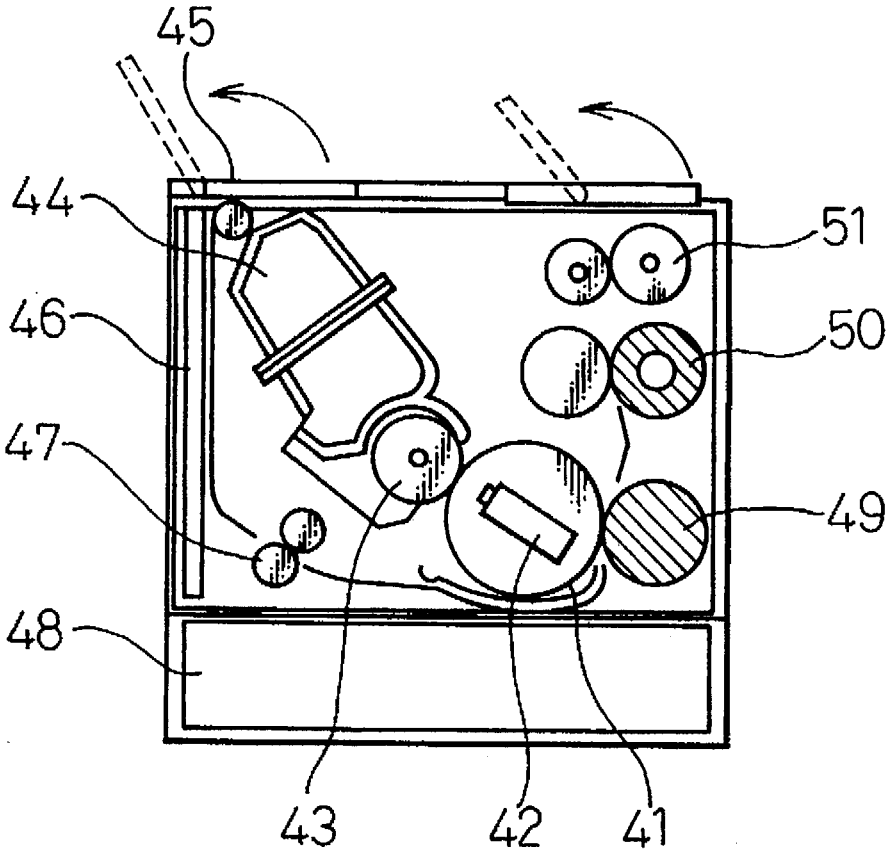
FIG. 4 is a view showing an optical back recording apparatus used in Examples.
Figure 5:
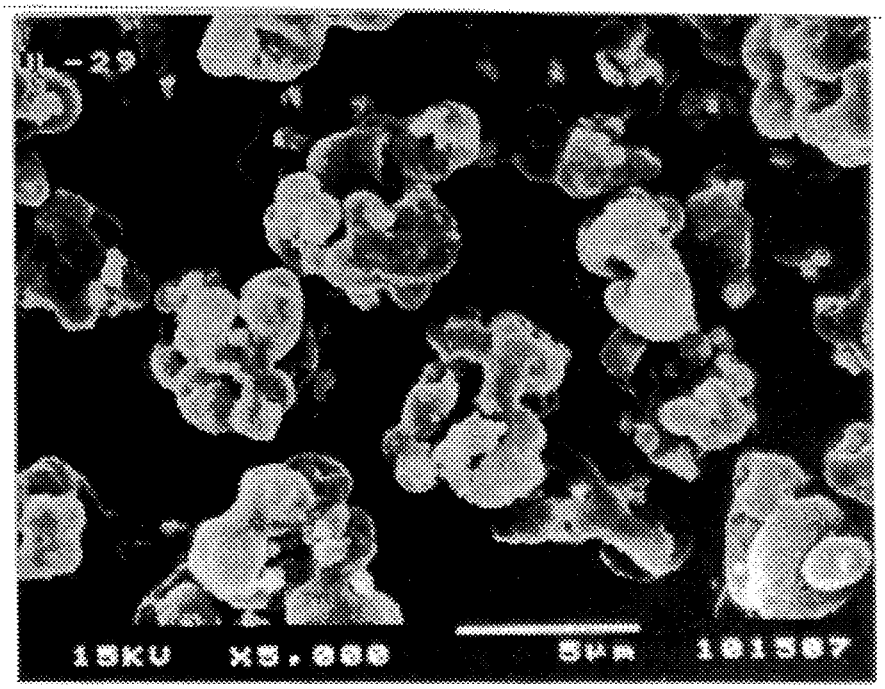
FIG. 5 is a photograph showing the shape of the particles of toner sample 1.
Figure 6:
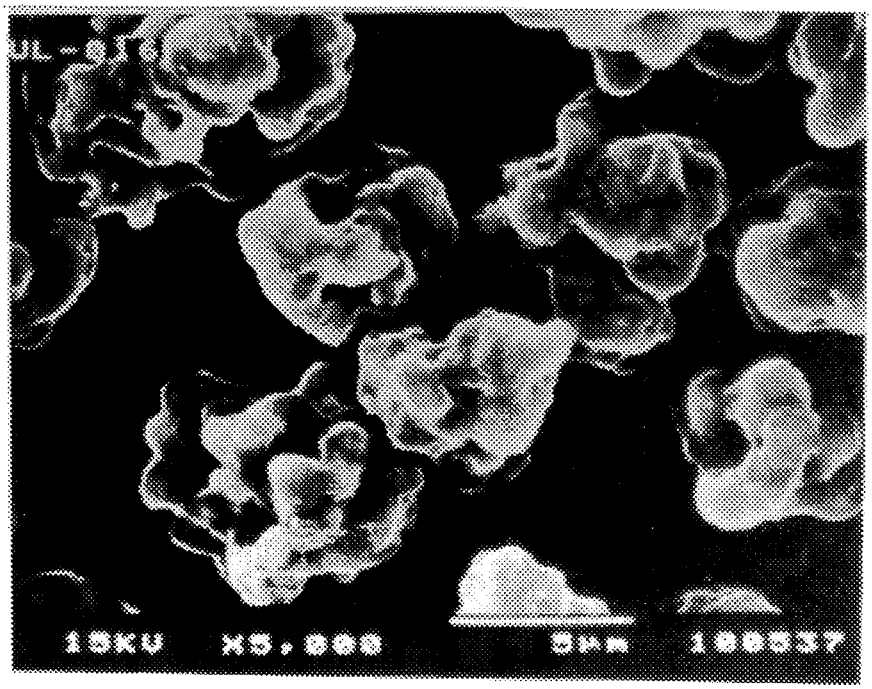
FIG. 6 is a photograph showing the shape of the particles of toner sample 2.
Figure 7:
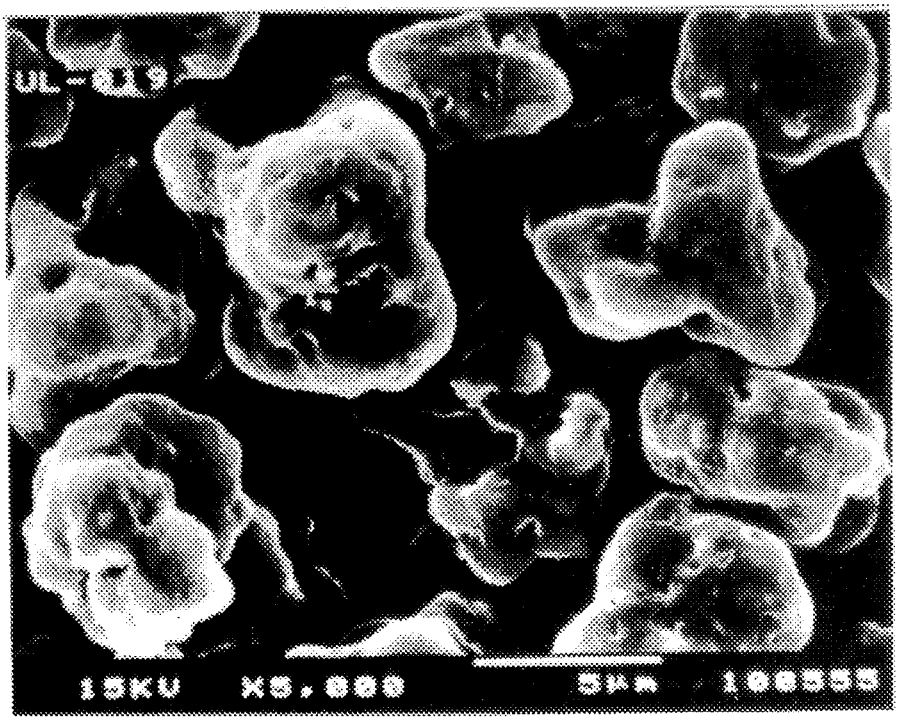
FIG. 7 is a photograph showing the shape of the particles of toner sample 3.
Figure 8:
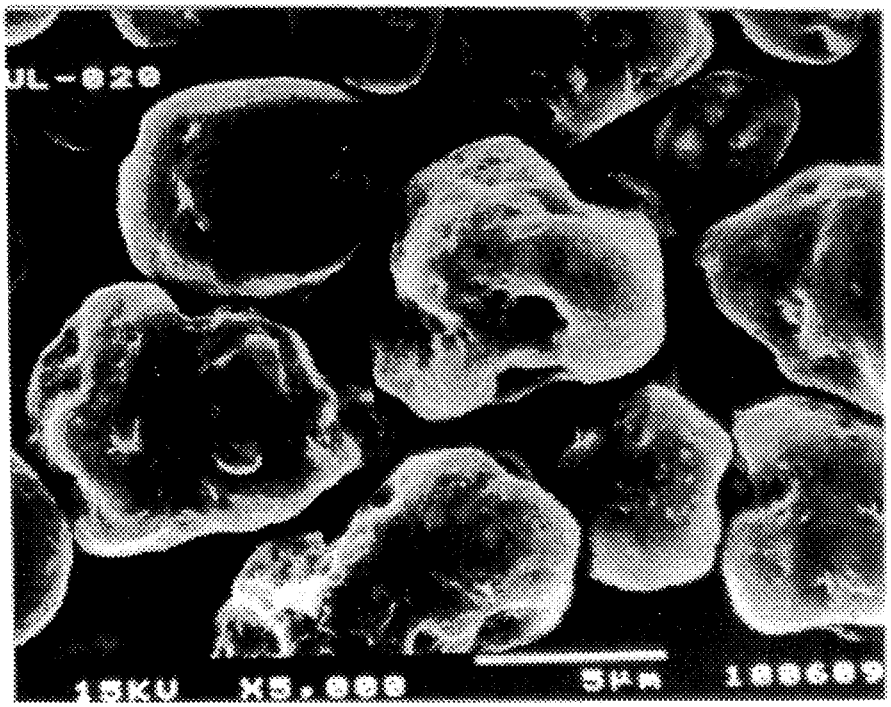
FIG. 8 is a photograph showing the shape of the particles of toner sample 4.
Figure 10:
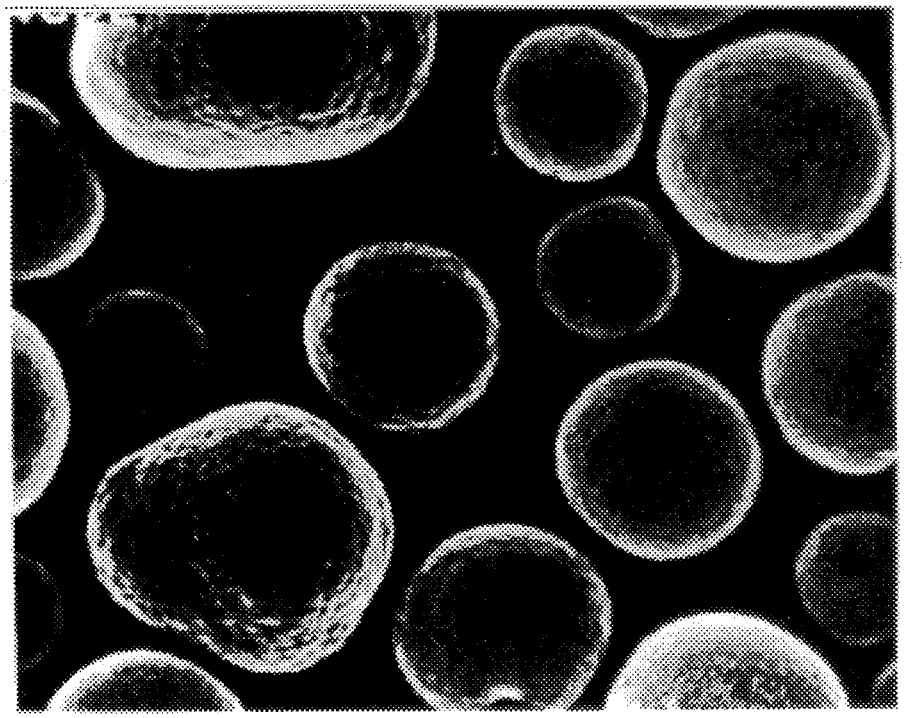
FIG. 10 is a photograph showing the shape of the particles of toner sample 6.
Figure 9:
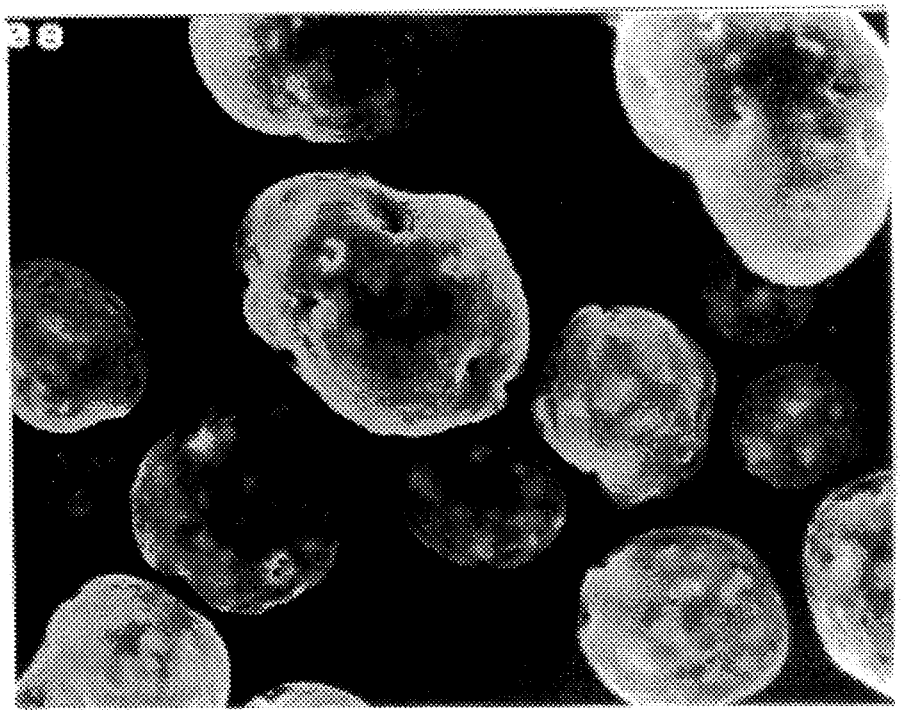
FIG. 9 is a photograph showing the shape of the particles of toner sample 5.
Figure 11:
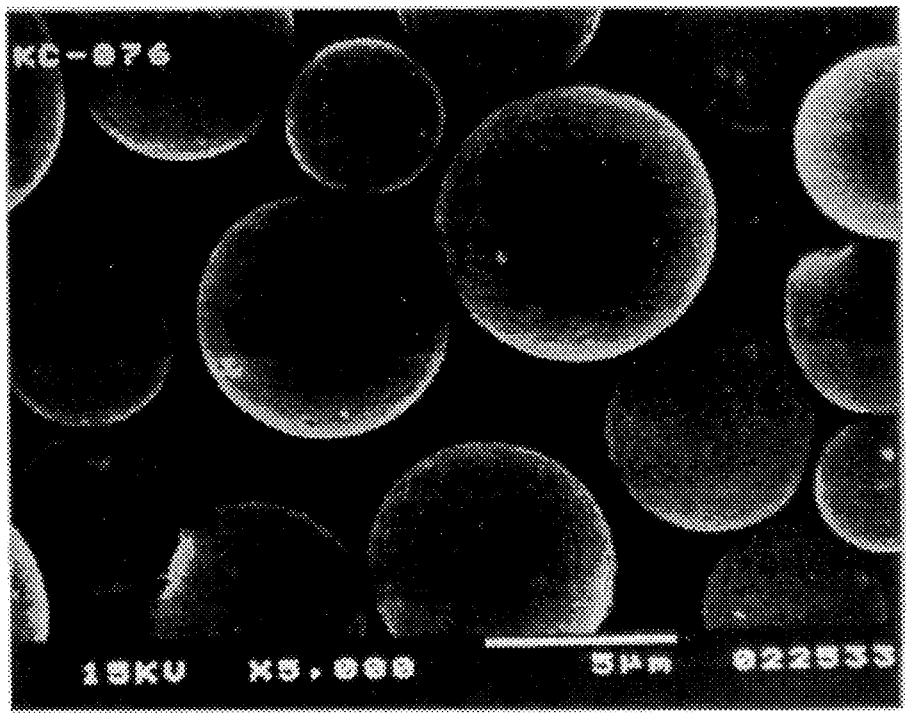
FIG. 11 is a photograph showing the shape of the particles of toner sample 7.

The construction of an actual apparatus using the method involving a carrier is shown in FIG. 4.

Toner Production Example (1)

a) Toners Having Varied Geometries

| | |
|---|---|
| [Monomers] | |
| Styrene (manufactured by Wako Pure Chemical Industries. Ltd.) | 50 parts by weight |
| Butyl acrylate (manufactured by Wako Pure Chemical Industries. Ltd.) | 10 parts by weight |
| [Polymerization initiator] | |
| N-50 (manufactured by Wako Pure Chemical Industries. Ltd.) | 2.5 parts by weight |
| [Release agent] | |
| Propylene wax (Viscol 550P; manufactured by Sanyo Chemical Industries. Ltd.) | 4 parts by weight |
| [Emulsifying agent] | |
| Neogen SC (manufactured by Dai-Ichi Kogyo Seiyaku Co., Ltd.) | 0.2 part by weight |

The above components were used to carry out emulsification polymerization at 70° C. for 3 hr, thereby preparing resin beads having a size of 1 to 2 μm.

| | |
|---|---|
| Resin beads | 60 parts by weight |
| [Colorant] | |
| Carbon (BPL) | 1 part by weight |
| [Magnetic powder] | |
| Magnetite (MTZ-703; manufactured by Toda Kogyo Corporation) | 40 parts by weight |
| [Charge control agent] | |
| Azo chrome dye (S-34; manufactured by Orient Corp.) | 1 part by weight |

The above mixture was maintained at 90° C. for 6 hr while dispersing and stirring in a slasher, during which time it was confirmed that the complex (toner) grew to a size of 10 to 12 μm. Then, in order to vary the shape of the toner, the complex was heated, in this state, in water at 90° C. for 0.5 to 30 hr. Thus, toners 1 to 7 having different shapes of 0.25 to 0.95 in Fs value (FIGS. 5 to 11) were prepared. These toners were collected by centrifugation. The toners were repeatedly washed with water until the pH value of these toners became 8 or less, thereby preparing magnetic toners having a volume average particle diameter in the range of 7.5 to 8.5 μm.

b) Toners Having Varied Amounts of Electrification

The shape of toners was specified in the same method as in the case of the toner having an Fs value of 0.81, and the amount (X parts by weight) of the azo chrome dye added was varied in the range of 0.5 to 10 parts by weight to vary the amount of electrification in the range of −10 to −80 μC/g.

Production of Carrier 1 g of methyltriethoxysilane was diluted with 1 litter of methanol to prepare a coating solution which was then coated by the rotary dry process onto 5 kg of a carrier core material (iron powder: average particle diameter 30 μm, manufactured by Powdertec Co., Ltd.). After coating, the coated carrier material was heat-treated in an air atmosphere at 120° C. for 1 hr, thereby preparing an experimental carrier.

The electric resistivity of the resultant carrier was $5\times10^5$ Ωcm.

Example 1

The above carrier and the above toner samples 1 to 7 having different shapes were used to prepare developers having a toner concentration of 10% by weight. These developers were used to compare optical back recording with the conventional recording system by means of an apparatus for an optical back recording system shown in FIG. 4 and a commercially available printer (M3876M: manufactured by Fujitsu, Ltd.)

Figure 12:
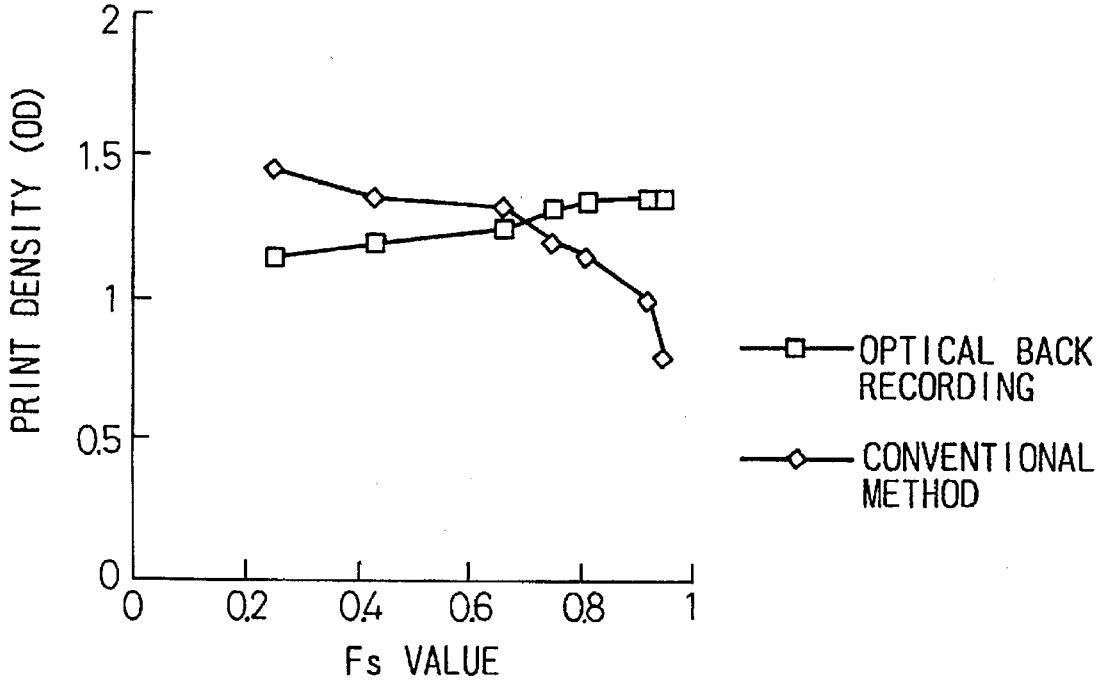
FIG. 12 is a diagram showing the relationship between the Fs value and the print density.
Figure 13:
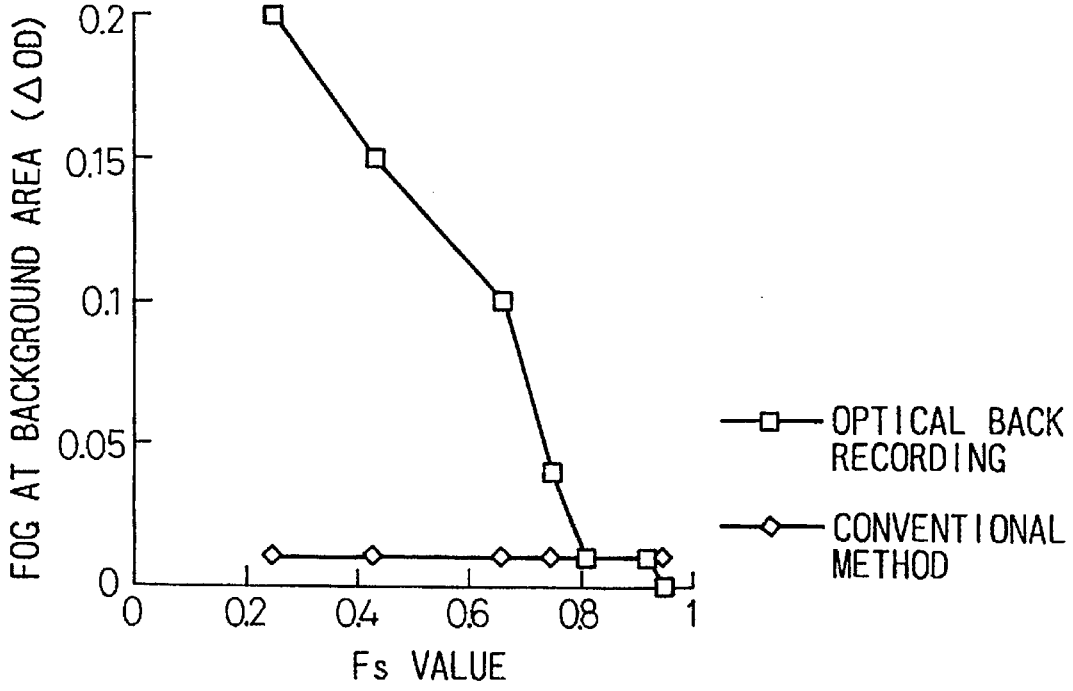
FIG. 13 is a diagram showing the relationship between the Fs value and the background fog.

The results are shown in Table 1, FIG. 12, and FIG. 13. For toners with the amount of electrification being about −20 μC/g, the print density and the background fog will now be examined. For optical back recording, the print density increases with increasing Fs values, whereas for the conventional process, it decreases with increasing Fs values (FIG. 12). The background fog rapidly decreases with increasing Fs values for optical back recording, whereas it does not vary for the conventional process (FIG. 13). Therefore, for optical back recording, a high print density and low fog can be realized when the Fs value is in the range of 0.75 to 0.95. However, a toner having an Fs value of 0.95 cannot be used because the resolution is reduced.

recording, in order to provide good printing properties, i.e., high print density and low fog, the amount of electrification should be in the range of −10 to −40 μC/g.

As can be seen from the above results, the conventional system and the optical back recording system have different margins from each other with respect to the amount of electrification and Fs value. Specifically, for optical back recording, good printing properties can be obtained when the Fs value is in the range of 0.75 to 0.90 with the amount of electrification being in the range of −10 to −40 μC/g, preferably when the Fs value is in the range of 0.75 to 0.85 with the amount of electrification being in the range of −20 to −30 μC/g.

TABLE 1

Results of Evaluation of Toners Having Varied Shapes

| Sample | Fs value | Amount of electrification (−μC/g) | System | Initial Fog | Initial Print density | After printing on 10000 sheets Fog | After printing on 10000 sheets Print density | Toner produced by pulverization process | Resolution |
|---|---|---|---|---|---|---|---|---|---|
| 1 | 0.25 | 20.1 | Optical back recording | x | x | x | x | x | x |
| | | | Conventional | v | v | v | v | x | x |
| 2 | 0.43 | 22.3 | Optical back recording | x | x | x | x | v | x |
| | | | Conventional | ⊙ | ⊙ | ⊙ | ⊙ | ⊙ | ⊙ |
| 3 | 0.66 | 21.1 | Optical back recording | Δ | v | x | v | v | v |
| | | | Conventional | v | v | v | v | v | v |
| 4 | 0.75 | 22.3 | Optical back recording | ⊙ | ⊙ | v | v | v | ⊙ |
| | | | Conventional | v | Δ | v | Δ | v | v |
| 5 | 0.81 | 20.6 | Optical back recording | ⊙ | ⊙ | ⊙ | ⊙ | ⊙ | ⊙ |
| | | | Conventional | v | Δ | v | Δ | v | v |
| 6 | 0.92 | 19.8 | Optical back recording | ⊙ | ⊙ | v | v | v | ⊙ |
| | | | Conventional | v | Δ | v | Δ | v | v |
| 7 | 0.95 | 21.2 | Optical back recording | v | v | v | v | v | x |
| | | | Conventional | v | Δ | v | Δ | v | v |

On the other hand, for the conventional process, good results can be obtained when the Fs value is in the range of 0.25 to 0.66, and the higher the sphericity of the toner, the lower the print density. This is probably because, when the fluidity of the spherical toner is excessively good, the toner deposited on the photoreceptor is scraped off with the magnetic brush of the developer.

Figure 14:
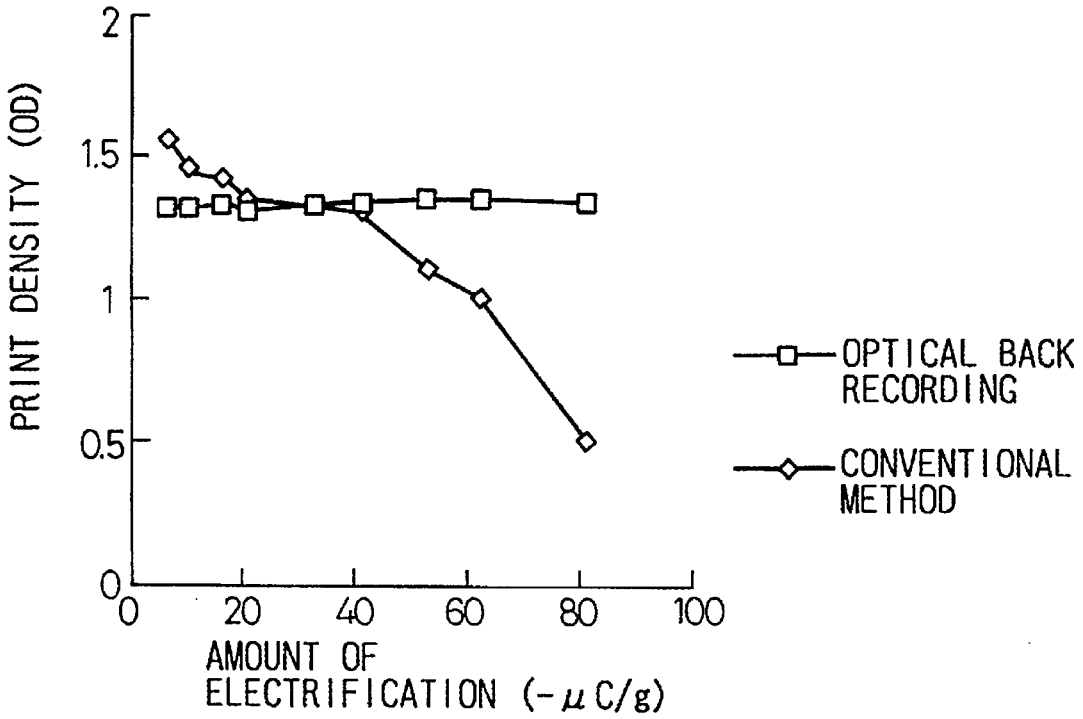
FIG. 14 is a diagram showing the relationship between the amount of electrification and the print density.
Figure 15:
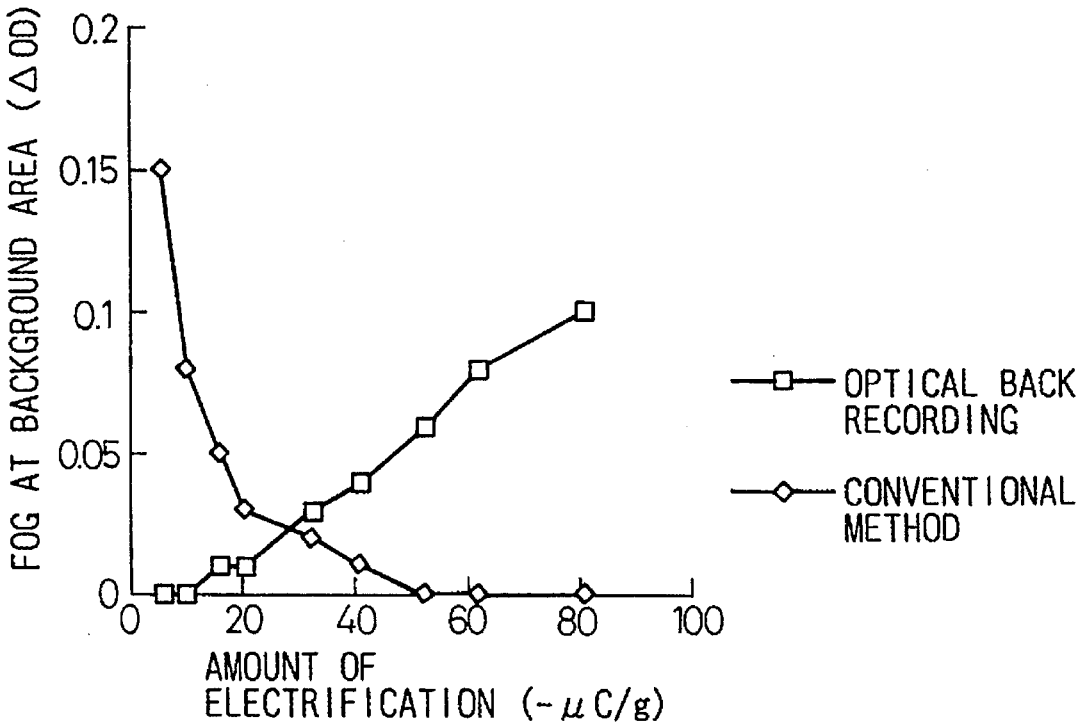
FIG. 15 is a diagram showing the relationship between the amount of electrification and the background fog.

Comparison of optical back recording with the conventional process was carried out using toners having an Fs value of about 0.8 and varied amounts of electrification (Table 2, FIG. 14, and FIG. 15). For optical back recording, the print density was substantially good independently of the amount of electrification, whereas for the conventional process, the print density decreases with increasing electrification (FIG. 15). Regarding the background fog, the tendency is opposite. Specifically, for the optical back recording, the fog increases with increasing electrification, whereas for the conventional process, the fog decreases with increasing electrification. Further, no transfer occurs when the amount of electrification is not more than −10 μC/g in terms of absolute value. Therefore, for optical back In Table 1, evaluation of the print properties was carried out as follows.

1. The print density was evaluated as ⊙ when OD was not less than 1.4; as v when OD was not less than 1.3; as Δ when OD was 1.2 to less than 1.3; and as x when OD was less than 1.2. The print density was measured with a Konica densitometer (PDA-65 manufactured by Konica Corp.)

2. The fog was evaluated as ⊙ when the print density difference ΔOD caused by fogging on the photoreceptor at ordinary temperature and ordinary humidity (25° C., 50%RH) was not more than 0.02; as v when ΔOD was not more than 0.05; and as x when ΔOD was less than that value. The print density difference (ΔOD) for the evaluation of the fog is a value determined by transferring onto a tape (Scotch Mending Tape) a powder image on the photoreceptor before the transfer of the powder image on paper, measuring the density of the white paper portion, and subtracting the density of the tape from the density of the white paper portion.

TABLE 2

Results of Evaluation of Toners Having Varied Amounts of Electrification

| Sample | Fs value | Amount of electrification (−μC/g) | System | Initial Fog | Initial Print density | Initial Transfer efficiency (%) |
|---|---|---|---|---|---|---|
| 8 | 0.84 | 6.1 | Optical back recording | v | Δ | x |
| | | | Conventional | x | v | x |
| 9 | 0.82 | 10.1 | Optical back recording | ⊙ | v | v |
| | | | Conventional | x | v | v |
| 10 | 0.85 | 16.3 | Optical back recording | ⊙ | ⊙ | ⊙ |
| | | | Conventional | v | Δ | v |
| 5 | 0.81 | 20.6 | Optical back recording | ⊙ | ⊙ | ⊙ |
| | | | Conventional | v | Δ | v |
| 11 | 0.78 | 32.8 | Optical back recording | ⊙ | ⊙ | ⊙ |
| | | | Conventional | v | Δ | v |
| 12 | 0.84 | 41.2 | Optical back recording | v | v | v |
| | | | Conventional | v | Δ | v |
| 13 | 0.81 | 52.8 | Optical back recording | x | v | v |
| | | | Conventional | v | x | v |
| 14 | 0.80 | 62.2 | Optical back recording | x | v | v |
| | | | Conventional | v | x | v |
| 15 | 0.77 | 81.2 | Optical back recording | x | v | v |
| | | | Conventional | v | x | v |

In Table 2, the print density and the fog were evaluated in the same manner as described above in connection with Table 1. The transfer efficiency was evaluated as ⊙ when it was not less than 90%; as v when it was not less than 80%; and as x when it was less than 80%.

Apparatus Embodiment (2)

In an optical back recording apparatus as shown in FIG. 3 (A), development may be carried out by applying a direct current voltage. In this embodiment, conditions were set as follows. An oscillatory voltage $V_{PP}$ was applied to the sleeve, with peak-to-peak voltage $V_{PP}$=1000 V and frequency 900 Hz, and direct voltage $V_{DC}$=−350 V. In this case, it was confirmed that conditions could be set as follows: $V_{PP}$=20 to 5000 V, frequency=100 to 10000 Hz, and direct current voltage $V_{DC}$=−150 V to −1000 V.

Toner Production Example (2)

Toner Prepared by Suspension Polymerization

| | |
|---|---|
| [Monomers] | |
| Styrene (manufactured by Wako Pure Chemical Industries. Ltd.) | 40 parts by weight |
| Butyl acrylate (manufactured by Wako Pure Chemical Industries. Ltd.) | 13 parts by weight |
| [Charge control agent] | |
| Azo chrome dye (S-34; manufactured by Orient Corp.) | 1 part by weight |
| [Polymerization initiator] | |
| Benzoyl peroxide (manufactured by Wako Pure Chemical Industries. Ltd.) | 1 part by weight |
| [Iron powder] | |
| Sicopur SE 0667 (particle diameter 0.3 μm, manufactured by BASF) | 40 parts by weight |
| [Colorant] | |
| Carbon (BPL) | 1 part by weight |
| [Release agent] | |
| Propylene wax (Viscol 550P, manufactured by Sanyo) Chemical Industries. Ltd.) | 4 parts by weight |

The above monomer, colorant, initiator, and wax were stirred by means of a disperser (manufactured by Yamato Scientific Corporation) for 3 min, thereby preparing a monomer composition. Then, the monomer composition was placed in 5000 parts by weight of distilled water containing 10 parts by weight of polyvinyl alcohol as a dispersant, and the mixture was stirred at room temperature (20° C.) by means of the disperser (1,000 r.p.m.) for 3 min. Thereafter, the disperser was replaced with a three-one motor, and the system was pressurized and heated at 80° C. while stirring at 100 r.p.m., thereby completely polymerizing the monomer composition. Then, the resultant toner dispersed in water was centrifuged and collected by filtration. Washing of the toner with water was repeated to prepare a dimple spherical magnetic toner having an average particle diameter of 6.0 μm. The toner had an Fs value of 0.85.

Example 2

An optical back recording apparatus of Apparatus Embodiment (2) was provided, and printing was carried out using different carriers as specified in Table 3 with the toner concentration being varied in the range of 10 to 30% by weight. Evaluation was carried out for print density, background fog, damage to the photoreceptor due to leaks, and deposition of carrier.

TABLE 3

| Carrier | $\sigma_{1K}$ | HH | R | RKI | Shape B/A | Shape C/A | Print density | Fog | Leak | Deposition of carrier |
|---|---|---|---|---|---|---|---|---|---|---|
| 1 | 96 | 1256 | $10^5$ | 31 | 0.55 | 0.22 | ⊙ | ⊙ | v | v |
| 2 | 96 | 1790 | $10^5$ | 30 | 0.60 | 0.15 | v | v | v | v |
| 3 | 96 | 1030 | $10^5$ | 29 | 0.50 | 0.30 | ⊙ | ⊙ | v | v |
| 4 | 96 | 904 | $10^5$ | 32 | 0.45 | 0.41 | x | x | v | v |
| 5 | 96 | 1256 | $10^7$ | 32 | 0.55 | 0.22 | v | x | v | v |
| 6 | 96 | 1256 | $10^1$ | 33 | 0.55 | 0.22 | v | v | x | v |
| 7 | 96 | 1020 | $10^5$ | 51 | 0.50 | 0.22 | x | x | v | v |
| 8 | 96 | 1101 | $10^5$ | 41 | 0.49 | 0.21 | v | v | v | v |
| 9 | 96 | 1332 | $10^5$ | 21 | 0.55 | 0.21 | v | v | v | v |
| 10 | 96 | 1534 | $10^5$ | 15 | 0.56 | 0.22 | v | v | v | x |
| 11 | 96 | 845 | $10^5$ | 31 | 0.50 | 0.50 | x | x | v | v |
| 12 | 96 | 403 | $10^5$ | 32 | 0.99 | 0.98 | x | x | v | v |
| 13 | 96 | 1038 | $10^5$ | 33 | 0.68 | 0.64 | x | x | v | v |
| 14 | 84 | 1250 | $10^5$ | 30 | 0.50 | 0.23 | v | v | v | x |

$\sigma_{1K}$: value of magnetic susceptibility at 1 KOe (emu/g), HH: specific surface area ($cm^2/g$), R: electric resistivity (Ωcm), RKI: particle diameter (μm), B/A and C/A: shape factor of carrier, and print density: when a good optical density property value of not less than 1.4 was obtained in a given toner concentration margin, i.e., in the toner concentration range of from 10 to 30% by weight, the print density was evaluated as ⊙; and when the optical density property value was not less than 1.3, the print density was evaluated as v. In this case, the optical density was measured with a Konica Densitometer PDA-65.

Fog was evaluated in the same manner as described above in connection with Table 1.

Leaking was evaluated as v when no damage to the photoreceptor was observed even after printing was continuously carried out on 10000 sheets.

The deposition of carrier was evaluated as v when no deposition of carrier was observed by visual inspection of the photoreceptor.

Toner Production Example (3)

50 parts by weight of a polyester resin (NE-2150, manufactured by Kao Corp.) as a binder resin, 40 parts by weight of a magnetic powder (magnetite, MTZ-703, manufactured by Toda Kogyo Corporation), 5 parts by weight of carbon black (Black Pearls L; average particle diameter 2.4 μm, specific area 138 $m^2/g$; manufactured by Cabot Corporation) as a colorant, 1 part by weight of a charge control agent (nigrosine, manufactured by Orient Chemical Industries Ltd.), and 4 parts by weight of propylene wax (Viscol 550P, manufactured by Sanyo Chemical Industries, Ltd.) were melt-kneaded with one another in a pressure kneader at 160° C. for 30 min, thereby preparing a toner mass. After the toner mass was cooled, it was crushed with a Rotoplex crusher to prepare a crude toner having a size of not more than about 2 mm. The crude toner was then pulverized by a jet mill (PJM pulverizer, manufactured by Nippon Pneumatic Mfg., Co, Ltd.). The resultant powder was classified by means of an air classifier (manufactured by Alpine K.K.) to prepare a positive electrification toner having an average particle diameter of 10 μm.

Example 3

In order to match the apparatus described in Apparatus Embodiment (2) with a positive electrification toner, the photosensitive layer, formed of a phthalocyanine compound, in the photoreceptor was replaced with a photosensitive layer formed of an amorphous silicon. The other conditions were the same as those described in Apparatus Embodiment (2). Development was carried out using as a carrier the carrier No. 1 specified in Table 3 and as a toner the toner prepared in Toner Production Example (3). As a result, the print density, fog, leak, and deposition of carrier on the photoreceptor were on the level of v.

According to the present invention, the optimization of a toner enables a good print density to be obtained in combination with the prevention of background fog in an optical back exposure process. Further, the optimization of a carrier enables good printing to be carried out for a long period of time without causing damage to a photoreceptor caused by leaks.

We claim:

1. A method for forming an image, comprising carrying out exposure and development of a toner substantially simultaneously with electrification of a photoreceptor by a carrier using an optical back recording system comprising: a photoreceptor comprising a laminate of a transparent or translucent substrate, a transparent or translucent conductive layer, and a photoconductive layer; a carrier and a toner disposed on the photoconductive layer side of said photoreceptor; and an imagewise-exposing means, for conducting imagewise exposure, provided at a position on the conductive layer side of said photoreceptor and facing said developing means, characterized in that said toner meets the requirement that the value determined by the equation $6/(d_t \cdot \rho_t \cdot S)$, wherein $d_t$ is the volume average particle diameter of the toner, $\rho_t$ is the density of the toner, and S is the specific surface area of the toner, is in a range of from 0.75 to 0.90 and the amount of electrification of the toner as measured by a magnet blow-off method is in a range of from 10 to 40 μC/g in terms of absolute value.

2. The image forming method according to claim 1, wherein said toner is an emulsification-polymerized toner composed mainly of associated particles including resin particles prepared by emulsification polymerization or non-emulsification polymerization, part of said resin particles being fused to one another, or a suspension-polymerized toner.

3. The image forming method according to claim 1, wherein said amount of electrification of the toner is in a range of 20 to 30 μC/g in terms of absolute value.

4. A method for forming an image carrying out exposure and development of a toner substantially simultaneously with electrification of a photoreceptor by a carrier using an optical back recording system, comprising: a photoreceptor comprising a laminate of a transparent or translucent substrate, a transparent or translucent conductive layer, and a photoconductive layer; a carrier and a toner disposed on the photoconductive layer side of said photoreceptor; and an imagewise-exposing means, for conducting imagewise exposure, provided at a position on the conductive layer side of said photoreceptor and facing said developing means, characterized in that said carrier meets the following requirements:

(1) magnetic susceptibility: not less than 90 emu/g (at 1 kOe), (2) specific surface area: 1000 $cm^2/g$ to 1800 $cm^2/g$, (3) electric resistivity: $10^2$ to $10^6$ Ωcm, and (4) average particle diameter: 20 to 45 μm.

5. The image forming apparatus according to claim 3, wherein said carrier meets a further requirement (5) that said carrier is a flaky iron powder having such a shape that, when sides of a rectangular parallelopiped circumscribed with the carrier are respectively assumed to be A, B, and C with A>B>C, A=B>C, or A>B=C, the average value of B/A is 0.30 to 1.00 and the value of C/A is 0.05 to 0.40.

6. The image forming apparatus according to claim 3 or 4, wherein said carrier is an iron powder coated with a resin.

7. A method for forming an image, comprising carrying out exposure and development of a toner substantially simultaneously with electrification of a photoreceptor by a carrier using an optical back recording system comprising: a photoreceptor comprising a laminate of a transparent or translucent substrate, a transparent or translucent conductive layer, and a photoconductive layer; a carrier and a toner disposed on the photoconductive layer side of said photoreceptor; and an imagewise-exposing means, for conducting imagewise exposure, provided at a position on the conductive layer side of said photoreceptor and facing said developing means, characterized in that said toner meets a requirement that the value determined by the equation $6/(d_t \cdot \rho_t \cdot S)$, wherein $d_t$ is the volume average particle diameter of the toner, $\rho_t$ is the density of the toner, and S is the specific surface area of the toner, is in the range of 0.75 to 0.90 and the amount of electrification of the toner as measured by a magnet blow-off method is in the range of 10 to 40 μC/g in terms of absolute value, and said carrier meets the following requirements:

(1) magnetic susceptibility: not less than 90 emu/g (at 1 kOe), (2) specific surface area: 1000 $cm^2/g$ to 1800 $cm^2/g$, (3) electric resistance: $10^2$ to $10^6$ Ωcm, (4) average particle diameter: 20 to 45 μm, and (5) a flaky iron powder having such a shape that, when sides of a rectangular parallelopiped circumscribed with the carrier are respectively assumed to be A, B, and C with A>B>C, A=B>C, or A>B=C, the average value of B/A is 0.30 to 1.00 and the value of C/A is 0.05 to 0.40.

* * * * *